United States Patent [19]

Matthews

[11] 4,286,987

[45] Sep. 1, 1981

[54] COMPOSITION FOR IRON POWDER COMPACT INFILTRANT

[75] Inventor: Paul E. Matthews, Lawrenceville, N.J.

[73] Assignee: United States Bronze Powders, Inc., Flemington, N.J.

[21] Appl. No.: 97,904

[22] Filed: Nov. 28, 1979

[51] Int. Cl.[3] ..... B22F 1/00; C23C 3/00

[52] U.S. Cl. ..... 75/252; 106/1.13; 106/1.18; 75/255

[58] Field of Search ..... 75/0.5 R, 0.5 BA, 251–255; 252/35; 427/242; 106/1.18, 1.13, 1.22, 1.26, 1.27

[56] References Cited

U.S. PATENT DOCUMENTS

| | | | |
|---|---|---|---|
| 3,481,714 | 12/1969 | Harrington et al. | 75/0.5 R |
| 3,652,261 | 3/1972 | Taubenblat | 75/0.5 R |
| 3,994,734 | 11/1976 | Cuthbert | 75/255 |
| 4,168,162 | 9/1979 | Shafer | 75/255 |

OTHER PUBLICATIONS

Boner, C. J., *Manufacture And Application of Lubricating Greases,* Rheinhold Publishing, pp. 152–153, 591–592 (1954).

*Primary Examiner*—Michael L. Lewis
*Attorney, Agent, or Firm*—Harvey B. Jacobson

[57] ABSTRACT

An infiltrant product composition is disclosed for impregnating an iron powder compact. The infiltrant alleviates typical problems associated with use of infiltrating materials, including partial dissolution of iron base matrix by the infiltrant with consequent severe erosion, oxidizing or reducing effects of furnace atmospheres on infiltrant yield, and incompatible characteristics of infiltrant with the iron base matrix. The preferred infiltrant composition is by weight about 98.25% copper alloy and 1.75% carbonyl type iron powder. An additional 0.05% of aluminum to reduce residual formation and minimize residual adherence and 0.5% of a conventional lubricant based on the copper-iron mixture are added. The infiltrant is in a dry, compactible form.

7 Claims, No Drawings

COMPOSITION FOR IRON POWDER COMPACT INFILTRANT

BACKGROUND OF THE INVENTION

1. Field of the Invention

This invention relates to a composition which is useful in the art of metal compacting, specifically for use with iron base alloy powder compacts consisting of iron powder and lubricant; iron powder, graphite and lubricant; iron powder, copper powder, graphite, and lubricant; and low alloy iron powders blended similarly. Such powder compacts can be infiltrated with typically copper or a copper base alloy in order to minimize compact porosity and/or modify the mechanical properties obtained in the standard compacting or sintering operations. While the process of infiltrating iron powder compacts is well established, the copper base alloys and alloy/mixtures employed in the infiltration process are in a constant state of change, each powder manufacturer seeking an idealized, trouble-free, high yield system.

2. Disclosure Statement

Various infiltrant compositions and processes for using infiltrants are known for impregnating iron and iron base alloy powder compacts, such as are disclosed in U.S. Pat. No. 3,652,261, issued Mar. 28, 1972, to Taubenblat. However, manganese and nickel are included as essential alloying components of the infiltrant disclosed by Taubenblat.

Cuthbert discloses in U.S. Pat. No. 3,994,734, issued Nov. 30, 1976, a high density infiltrating paste made from a metal powder blend containing from about 1.8 to 3.4% of preferably carbonyl iron powder, but does not disclose a dry, compactible, form of infiltrant which can be effectively used without the addition of a liquid vehicle. A copper base alloy containing a minor proportion of aluminum is disclosed by Hechinger in U.S. Pat. No. 3,146,095, issued Aug. 25, 1964.

Fisher discloses in U.S. Pat. No. 3,619,170, issued Nov. 9, 1971, a copper based infiltrating powder including iron, a refractory material parting agent, and a small amount of an iron-chromium alloy as a release agent. Michael in U.S. Pat. No. 3,307,924, issued Mar. 8, 1969, also discloses a powder infiltrant composition comprising copper, iron, and a refractory parting agent. Both Fisher and Michael do not disclose the use of carbonyl iron.

Other copper based infiltrant compositions are disclosed in U.S. Pat. Nos. 4,130,422, issued Dec. 19, 1978, to Wang et al; 3,829,295, issued Aug. 13, 1974, to Farmer et al. Other patents bearing a relation to the field of the invention include the following:

U.S. Pat. No. 3,120,436—Feb. 4, 1964—Harrison
U.S. Pat. No. 3,623,630—Nov. 30, 1971—Rode
U.S. Pat. No. 3,706,550—Dec. 19, 1972—Umehara et al.
U.S. Pat. No. 3,838,982—Oct. 1, 1974—Sanderow et al.
U.S. Pat. No. 4,011,077—Mar. 9, 1977—Kaufman.

SUMMARY OF THE INVENTION

This invention overcomes historical difficulties related to infiltrating iron base alloy materials with copper base alloys including partial dissolution of the iron base matrix by the copper base infiltrant resulting in external and/or internal erosion and affecting mechanical integrity of the infiltrated part, as well as oxidizing or reducing effects of furnace atmospheres used to treat a sintered infiltrated compact, upon the metallurgical chemistry of infiltrant components and the resultant effects upon infiltrant yield and troublesome residue formation, as well as infiltrant melting characteristics incompatible with the iron powder matrix prealloying forming stage that allows at least partial reaction prior to the liquifying of the infiltrant. These difficulties have been overcome by provision of a particular composition representing a compactible blend of predominately copper-based alloy, a carbonyl type iron powder and a small quantity of aluminum, added to reduce residual formation and adherence.

Accordingly, an object of the invention is to provide an improved infiltrating powder for use with an iron or low alloy iron powder compact.

Another object is to provide an infiltrant composition for increasing the density and strength of porous iron compact skeleton.

Another object is to provide an infiltrant composition which overcomes the previous problem of partial dissolution of the iron compact matrix.

Yet another object is to provide an infiltrant composition which reduces residual formation and minimizes residual adherence to the iron compact workpiece.

Further object objects and advantages of the present invention will become apparent from a detailed description of the invention hereinafter presented.

DESCRIPTION OF THE INVENTION

The infiltrant composition of this invention comprises a dry compactible mixture of copper or copper based alloys, iron powder produced by the carbonyl process, and a minor amount of aluminum. Conventional lubricants can also be added. The infiltrant of the present invention is to be used in the conventional process of infiltrating porous iron compact body.

The copper or copper based alloy used in the infiltrant of this invention is typically an atomized powder made using conventional atomizing techniques and equipment for the making of metal powders. A particle size range of the atomized infiltrant copper or copper alloy powder of from less than 60 mesh to minus 325 mesh (U.S. Standard Sieve) with about 40% to 50% being below 325 mesh has been found satisfactory to provide desirable flow characteristics during infiltration.

The iron powder used is one that is formed by the carbonyl process (carbonyl iron). The addition of the carbonyl iron powder to the infiltrant satisfies the dissolving power of copper for iron thus minimizing the dissolution of the iron compact matrix. The carbonyl iron powder has both the activity and the fine particle size required for rapid solubility in the copper based infiltrant. The partial dissolution of the iron matrix by the copper based infiltrant results in severe external and/or internal erosion, thus affecting mechanical integrity and/or aesthetic value of the infiltrated workpiece. The carbonyl iron powder used in the infiltrant composition is finer than about 325 mesh.

The copper or copper alloy powder can be physically blended with the carbonyl iron powder by any suitable means. The amount of copper base in the copper-iron mixture ranges from about 97% to 99% by weight, the carbonyl iron, 1% to 3% by weight. Preferably, a copper-carbonyl iron mixture contains about 98.25% copper or copper base alloy and about 1.75% carbonyl iron.

Ideally, infiltrating materials should leave no residuals, such as non-reduced oxides, lubricant decomposition products, or copper insoluble elements on the infiltrated iron compact workpiece. In those infiltrant compositions designed to leave residuals of non-infiltrated constituents, the residuals should be easily removed without resorting to mechanical means. To reduce the amount of residuals formed and to prevent the adherence of residuals to the infiltrated iron compact workpiece, the infiltrant composition of this invention includes a minor amount of aluminum, about 0.01% to 0.10% by weight with respect to the copper-iron mixture. The aluminum can be added in various forms, such as metal powder, metal flakes, alloyed aluminum/brass, and aluminum stearate. The amount of residuals formed are reduced to less than 6% dry weight of the infiltrant by use of the infiltrant composition of this invention, and in most cases to less than 2% by weight. Also, the adhesion of residuals to the iron compact workpiece is minimal due to the addition of the aluminum to the infiltrant composition and can be easily removed. The inclusion of aluminum to the infiltrant composition further reduces the liquid flow of the infiltrant mass as melting occurs, thus minimizing run off from the iron compact workpiece.

The infiltrant composition of this invention can also include the conventional lubricants in an amount of between about 0.5% to 1.% by weight relative to the copper-iron mixture.

In practice, the infiltrant composition of this invention can be contacted with the porous iron compact workpiece and thereafter heated to sufficiently raise the temperature of the infiltrant composition to above the infiltrant melting temperature to infiltrate and fill the voids of the porous iron compact. Infiltration can be carried out at temperatures slightly above the melting point of copper, about 2000° F. to about 2300° F. A temperature of about 2050° F. is conventionally used. Infiltration can be achieved in about 15 minutes to about 1 hour. Various furnace atmospheres can be used including reducing atmospheres, such as hydrogen or cracked ammonia, or an inert gas atmosphere. A wide range of atmospheric dew points can be used for infiltration without adversely affecting infiltrant yield and residual removal.

The following examples show the critical features of the invention, but should not be construed as limiting the invention:

COMPARATIVE EXAMPLE

Iron Compact Base Blend

| | |
|---|---|
| Iron (Hoeganaes AMH-100) | 100 parts by weight |
| Graphite (South Western 1651) | 1 part by weight |
| Lubricant (Zinc Stearate, NOPCO PMG) | .75 parts by weight |

The iron base blend was compacted into cylindrical slugs, 1.5" diameter, 0.75' height to a green density of 6.2 g/cm$^3$; approximate weight, 136 g.

Infiltrant Blend

An atomized copper powder alloy employed as the base of the infiltrant blend was a minus 60 mesh type having a nominal minus 325 mesh fraction of 40% to 50%, designated USB grade C-140. To this base powder was added 0.5% by weight of a standard lubricant (Nopcowax 22DS). The lubricated infiltrant blend was compacted into transverse bars, 1.25" length×0.50" width×0.300" thickness by compacting under 30 tons per square inch briquetting pressure. The weight of the infiltrant blend was approximately 27 g.

Infiltration was performed by placing the iron compact base slug in a sintering tray, with the whole transverse bar of the infiltrant on top center and pushing the test piece into the furnace hot zone (approximately 2050° F.). The furnace atmosphere gas was disassociated ammonia having an "as cracked" −55° F. dew point; time at temperature, 30 minutes.

By visual inspection, it was noted that erosion of the iron base compact occurred due to dissolution by the copper alloy infiltrant. Therefore, to decrease the erosion, iron addition to the base powder infiltrant was necessary to satisfy the base copper powder solvent with iron prior to the flow into the base iron compact workpiece to be infiltrated.

Iron Powder Addition

Various type iron powder additions were evaluated in the following manner. The iron compact base blend of the comparative example was used as the workpiece. The following infiltrant compositions were formed into transverse bars as above, each transverse bar weighing approximately 27 g. The conditions for all the infiltrations were as above in the comparative example.

Infiltrant Composition

| | | | |
|---|---|---|---|
| C-140 Copper | 98.25% | (by weight) | |
| Iron (see below) | 1.75% | " | |
| Lubricant (Nopcowax 22DS) | 0.5% | " | (based on copper-iron mixture) |
| Aluminum (AMPAL 631) | 0.05% | " | (based on copper-iron mixture) |

The types of iron powder additions are shown in Table I, each evaluated utilizing the above standard composition. Table I below shows the results of infiltration utilizing the various iron additions.

TABLE I

| IRON TYPE (−325 MESH) | | % RESIDUE | REMARKS |
|---|---|---|---|
| Hoeganaes | AMH-100 | — | Residuals non-removable |
| Hoeganaes | MH-300P | — | " |
| GAF | MR | .18 | Removable residue-no erosion |
| " | HP | .50 | Removable residue-no erosion |
| " | TH | .55 | Slight residue - slight erosion |
| " | SE | .66 | Slight residue-slight erosion |
| " | E | .74 | Slight residue - slight erosion |

The most effective iron powder additions were those manufactured by the carbonyl process. The sponge iron products, screened through 325 mesh, such as Hoeganaes AMH-100 and MH-300P were not effective in this system since rapid solution of the iron into the copper did not occur, and high iron concentrations were left behind after infiltration had taken place. Of the carbonyl iron tested, GAF grades MR and HP were the most effective.

Aluminum Addition

Additions of aluminum in various forms, metal powder, metal flakes, alloyed aluminum/brass, and aluminum stearate within the range of 0.01% to 0.10% by weight as aluminum were evaluated and found effective in the prevention of the adhering of residuals to the base iron compact; however, it appears that the finer the aluminum distribution, the lower the total residuals at equal amounts. Table II below shows the results substituting various aluminum materials in the infiltrant compositions shown in Table I above. Carbonyl iron was used in all of the tests. The iron compact base blend, the conditions of infiltration, and the compactible form of the infiltrant blend were the same as used in the comparative example.

TABLE II

| % Al | Al FORM | % RESIDUALS |
|---|---|---|
| 0.10 | [1]AMPAL 631 powder | 1.10 |
| 0.05 | " | 0.50 |
| 0.05 | [2]Al brass powder | 5.5 |
| 0.025 | " | 3.71 |
| 0.05 | [3]Al flake | 1.84 |
| 0.0125 | [4]Al stearate | 0.37 |

[1]AMPAL 631 Atomized metal products (−325 mesh)
[2]Al Brass USB alloy-2 Cast (−325 mesh)
[3]Al Flake USB 913-S (−325 mesh)
[4]al Stearate Al di/tri-stearate (−325 mesh)

As can be seen from the Table, the amount of residuals was reduced to less than 2% in most cases. Aluminum stearate was most effective in reducing the amount of residuals. The use of aluminum stearate also eliminates a potential fire hazard when utilizing aluminum in metal powder form in the infiltrant composition.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A dry compactible infiltrant composition for impregnating iron and iron base alloy powder compacts, said composition consisting of a copper-iron mixture containing by weight about 97% to 99% copper or copper base alloys having a particle size less than 60 mesh and about 1% to 3% carbonyl iron powder having a particle size finer than 325 mesh, and between about 0.01% to 0.10% by weight of said mixture of aluminum, to effectively reduce residual formation to about 5.5% or less by weight and optionally containing a lubricant.

2. The composition of claim 1, further containing a lubricant.

3. The composition of claim 1, wherein said aluminum is aluminum stearate.

4. The composition of claim 2, wherein said mixture consists of about 98.25% copper or copper base alloy, about 1.75% carbonyl iron, said aluminum is an aluminum metal powder in an amount of 0.05% by weight based on said mixture and said lubricant is added in an amount of about 0.5% based on the weight of said mixture.

5. A dry compactible infiltrant composition for impregnating iron and iron base alloy powder compacts, said composition consisting essentially of a copper-iron mixture containing by weight about 97% to 99% copper or copper base alloy and about 1% to 3% carbonyl iron powder by weight having a particle size finer than 325 mesh, and 0.01% to about 0.1% by weight as aluminum of aluminum stearate to effectively reduce residual formation to about 5.5% or less by weight and substantially reduce adhesion after infiltration.

6. The composition of claim 5, further containing a lubricant.

7. The composition of claim 6, wherein said mixture comprises about 98.25% copper or copper base alloy and about 1.75% carbonyl iron powder.

* * * * *